United States Patent [19]

Grycel

[11] 4,190,980

[45] Mar. 4, 1980

[54] MODEL SAILBOAT SHEET WINCH

[76] Inventor: Felix J. Grycel, 1404 Jackson, Port Townsend, Wash. 98368

[21] Appl. No.: 871,344

[22] Filed: Jan. 23, 1978

[51] Int. Cl.[2] ..... A63H 23/02

[52] U.S. Cl. ..... 46/93; 46/250; 46/39; 114/144 A; 254/185 R

[58] Field of Search ..... 46/210, 250, 253, 254, 46/262, 93, 39, 40; 254/185 R; 114/144 A, 160, 161

[56] References Cited

U.S. PATENT DOCUMENTS

| | | | |
|---|---|---|---|
| 238,671 | 3/1881 | Frick | 114/160 |
| 2,834,152 | 5/1958 | Lambert | 46/93 X |
| 3,016,228 | 1/1962 | Boomkens | 254/185 R |
| 3,206,168 | 9/1965 | Scholefield et al. | 46/39 X |
| 3,280,501 | 10/1966 | Hornbostel | 46/93 X |
| 3,765,362 | 10/1973 | Gitchel | 46/250 X |

*Primary Examiner*—Russell R. Kinsey
*Assistant Examiner*—Mickey Yu
*Attorney, Agent, or Firm*—Robert G. Upton

[57] ABSTRACT

A dual sheet winch apparatus is disclosed to manipulate a Genoa type of foresail on a model sailboat. Each line is attached to the clew of the Genoa at a first end, one line being reeled in or out at its second end by a port winch, the other being reeled in or out at its second end by a starboard winch for the control of the Genoa foresail for model sailboat maneuvering purposes. The separate winches are manipulated by a remotely controlled geared electric motor.

7 Claims, 5 Drawing Figures

MODEL SAILBOAT SHEET WINCH

BACKGROUND OF THE INVENTION

1. Field of the Invention

This invention relates to the field of model sailboats. More particularly this invention relates to the field of radio-controlled model sailboats wherein a large Genoa type of foresail is manipulated rather than the normal state of the art foresail which is controlled by one line attached to a boom at the base of the foresail that must swing before the mast.

2. Description of the Prior Art

State of the art torquer sail control devices use a single geared electric motor to rotate a double pole beam that has a center pivot that controls both the foresail (the sail positioned on the front of the sailboat) and a main sail, which trails behind the main mast, the foresail and main sail being synchronously controlled by the torquer device. The conventional torquer device forces the foresail of the sailboat to be small in size in that the foresail utilizes a boom attached to the base of the foresail and the boom must swing or pivot from the bow of the sailboat, the opposite end of the boom passing in front of the mast of the sailboat. Thus it can be seen that the foresail is, by necessity, small in size. This is true because there is a single sheet line that controls the foresail and goes from the end of the boom to one end of the geared torquer device. You cannot control a Genoa type of foresail that characteristically has no boom with a single sheet line attached to a torquer beam.

The present invention easily controls a large boomless Genoa type foresail in that the Genoa has two lines, one on each side of the mast, attached to the clew of the Genoa, thus allowing the Genoa to pass before the mast. Therefore the Genoa can be much larger than the state of the art foresails that require a boom for control. State of the art torquer control devices control this type of a self-tending jib.

The present two line remotely controlled starboard and port winch system enables a model sailboat to be operated almost exactly like a full-scale sailboat especially where the mainsail is separately and remotely maniuplated. The sheets connected between a Genoa type sail and, the electrically driven winch drums and the apparatus to remotely control the winches is the subject of the present invention.

SUMMARY OF THE INVENTION

A means to remotely manipulate a relatively large boomless foresail on a model sailboat is disclosed to maneuver the sailboat upon a body of water comprising a housing, with a first port side sheet winch rotatable on a powered shaft positioned within the housing, the port side sheet winch is free-wheeling on the shaft, the end of a sheet wound on the port side sheet winch is attached to the clew of the boomless foresail. A starboard side sheet winch is rotatable on the powered shaft positioned within the housing, the starboard side sheet winch is free-wheeling on the shaft, the end of a sheet wound on the starboard side winch is attached to the clew of the boomless foresail.

A port side spring clutch mechanism is connected at a first end to a driving arbor connected to the powered shaft, the arbor being positioned between the port and starboard sheet winches, the opposite end of the port side spring clutch concentrically overlapping a hub of the port side sheet winch, the overlapping end of the port side spring clutch having an inner diameter slightly larger than the outside diameter of the hub of the port side sheet winch to allow the free-wheeling port side sheet winch to rotate within the port side spring clutch when the clutch is disengaged with the port side sheet winch. A starboard side spring clutch mechanism, the spring clutch having its windings wound opposite to the windings in the port side spring clutch mechanism, the starboard side spring clutch mechanism connected at a first end of the driving arbor positioned between the port and starboard winches, the opposite end of the starboard side spring clutch concentrically overlapping a hub of the starboard side sheet winch, the overlapping end of the starboard side spring clutch having an inner diameter slightly larger than the outside diameter of the hub of the starboard side sheet winch to allow the free-wheeling starboard side sheet winch to rotate within the starboard side spring clutch when the clutch is disengaged with the starboard side sheet winch.

A servo mechanism is operated by the remote manipulating means to position a control arm retained within the housing back and forth a predetermined distance, the control arm being spaced from the substantially parallel to the powered shaft, the control arm further comprising a cam surface thereon to engage or disengage a trigger device mounted to the housing to start and stop the powered shaft, the trigger device being in communication with the cam surface of the control arm.

A bell crank means is utilized to engage or disengage the port and starboard sheet winches by manipulation of the port and starboard spring clutch mechanisms, the bell crank is positioned between the powered shaft and the control arm and is pivotably mounted near the center of the bell crank to the housing, a first arm of the bell crank is pivotably connected to the control arm, a second and third arm of the bell crank in substantially parallel relationship with one another, are positioned 180 degrees from the first arm, the second and third arms having brake pad means attached to the ends of the second and third arms, each brake pad is spaced from and adjacent the hubs of the port and starboard sheet winch when the bell crank is positioned in a neutral position by the control arm, when the control arm is moved passed a neutral position, the bell crank is rotated which engages either the port or starboard sheet winch. An interference contact by the brake pad with the overlapping end of the port or starboard spring clutch mechanism results in the coils of the spring to retract thereby reducing the inside diameter of the overlapping end thus engaging the port or starboard hub of the sheet winch, the bell crank and the trigger device being operated simultaneously by the remotely manipulated servo connected to the control arm to start and stop the powered shaft and to engage or disengage either the port or starboard sheet winch to provide a precise means to move out, pull in or set the clew of the foresail whether the sail is on the port or starboard side or transitioning therebetween on the model sailboat.

A dual sheet wintch apparatus is disclosed to control a relatively large Genoa type of sail on a model sailboat, each line or sheet being attached to the clew of the Genoa at one end, one line being winched by a port winch, the other being winched by a starboard winch for the control of the Genoa foresail, each line being on separate sides of the mast. The separate winches are driven by a remotely controlled geared electric motor. The geared electric motor is controlled by a lever arm which has a cam surface therein, the lever arm is attached to one end of a remotely controlled servo mechanism. The lever arm is designed so that the cam surface engages a micro switch with a trailing arm cam follower thereon. The cam surface engages and disengages the micro switch to control the rotation of the geared electric motor as well as having the ability to stop or "lock" the motor at various winch positions to control the "trim" of the Genoa sail. The end of the lever arm is attached to one leg of a three-legged bell crank, the pivotable bell crank having two oppositely extending legs that engage with a pair of spring clutch mechanisms which communicate with one or the other of the drum spools depending on which of the spools is to be driven. By manipulating the servo mechanism fore and aft by the remote transmitter, the lever arm is so positioned to simultansouely engage the cam follower on the micro switch, thereby starting or stopping the geared electric motor to drive the drive shaft and to engage one of the spring clutches attached to a driving arbor connected to the drive shaft to drive either the port or starboard spools mounted in a free-wheeling relationship on the drive shaft. In one direction, the bell crank engages one of the legs of the bell crank with, for example, the starboard spring clutch, thereby driving the starboard winch while allowing the opposite spool to run free on the shaft that is connected at one end to the geared electric motor and at the other end to a bearing in the housing containing the winch mechanism. Thus with the lever arm in one position, the spring clutch being securely engaged with the starboard winch, enables the geared electric motor to reel in the starboard winch thereby reeling in the starboard line attached to the clew of the Genoa. The other line attached to the port spool is allowed to go slack since the port spool or drum is free-wheeling. The Genoa then is pulled in on the starboard side and allowed to pass before the mast to accommodate a different tack of the model sailboat. The starboard winch may be disengaged by moving the servo mechanism fore or aft, thereby disengaging the clutch of the starboard winch to release the starboard spool, or the servo arm may be driven back just far enough to stop the geared electric motor thereby locking in the starboard spool, thus holding the starboard sheet to "set" the Genoa.

Therefore it can be realized that a very large Genoa type sail may be precisely and easily manipulated by utilizing the starboard and port sheet spools with a geared electric motor. These spools or drums then may be engaged, disengaged, or locked by the fore and aft position of the servo mechanism that is controlled by a remote transmitter/receiver device. Therefore the model sailboat may be manipulated or controlled for the first time almost as precisely as a full-size sailboat may be manipulated with a full crew complement. The advantage of the present invention over the prior art is clearly obvious.

Therefore it is an object of this invention to provide a model sailboat sheet winch device which enables the model sailboat enthusiast to precisely manipulated a large Genoa type of foresail on his boat.

More specifically, it is an object of this invention to provide a model sailboat sheet winch apparatus which includes a pair of sheet winches one starboard and one port sheet winch to control two lines each of the starboard and port lines being attached to the clew of the Genoa, thus allowing the large Genoa sail to pass before the mast in a manner which exactly duplicates the method in which a Genoa is manipulated on a full-size sailboat.

An advantage over the prior art device, then is the ability to control a large Genoa type sail without the necessity of a boom which must pass before the mast, thereby greatly restricting the size of the foresail.

Yet another advantage over the prior art is the utilization of a pair of driven spools to control the clew of the Genoa sail whereas the prior art device has only a single line attached to an arm of a servo mechanism which controls the boom connected to the base of the foresail. The above-noted objects and advantages of the present invention will be more fully understood upon a study of the following detailed description in conjunction with the detailed drawings.

DESCRIPTION OF THE PREFERRED EMBODIMENTS

Figure 1:
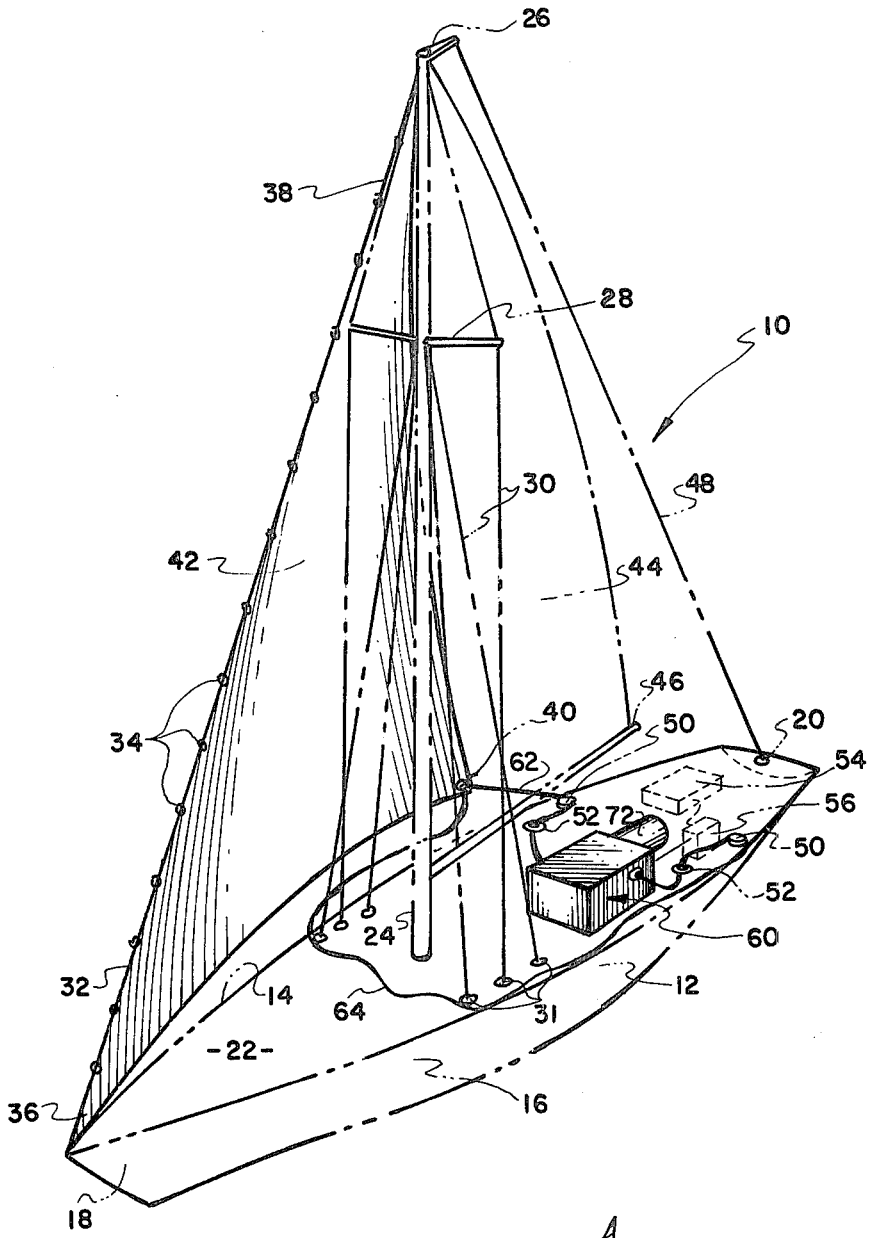
FIG. 1 is a perspective view of a typical model sailboat illustrating a large Genoa type of foresail which is manipulated by a pair of sheet lines, one emanating from the starboard side of the sailboat, while the other emanates from the port side of the sailboat. The ends of both sheet lines being attached to the clew of the Genoa.

Turning now to FIG. 1 the model radio controlled sailboat generally designated as 10 consists of a hull 12, starboard side 14, port side 16, bow 18 and stern 20 with a deck 22 completing the hull of the sailboat. A center mast 24 extends above the deck 22, the mast is held rigid by shrouds 30 at the upper end just below the spreader arms 28 and they are firmly affixed to the hull 12 by the chain plates 31. At the upper most end of the mast 24 is a mast head 25. A head stay 32 is anchored at the bow 18 and extends upwardly and is anchored at the mast head of 26. A multiplicity of jib hanks 34 retain the luff of the Genoa foresail 42 to the head stay 32. The tack 36 of the foresail 42 is positioned at the bow 18 of the sailboat. The head 38 of the foresail is near the mast head 26 and the clew 40 of the foresail is at the junction of the foot and the leach. A main sail 44 trails behind the mast 24 and is affixed to a boom 46 at its bottom edge or foot and is attached at the top or head to the mast head 26 of mast 24. A back stay 48 is positioned at the upper end to the mast head 26 and at its lower end to the stern 20 of the hull 12.

Figure 2:
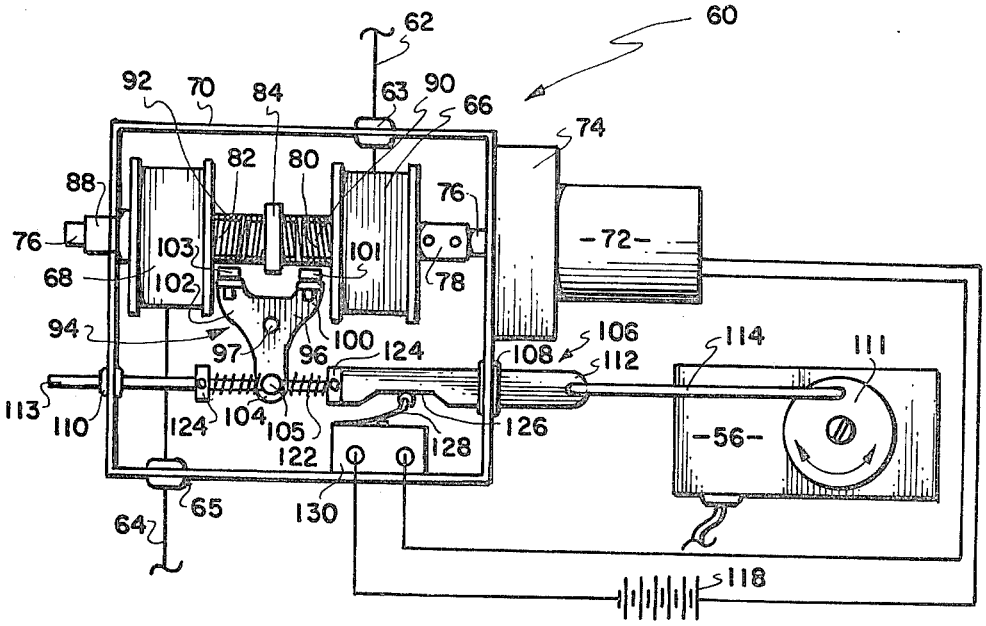
FIG. 2 is a semi-schematic view of the dual spool winch illustrating the spring clutch mechanism, the bell crank device, the manipulating arm with cam surface and the micro switch which is electronically attached to the geared electric motor.
Figure 3:
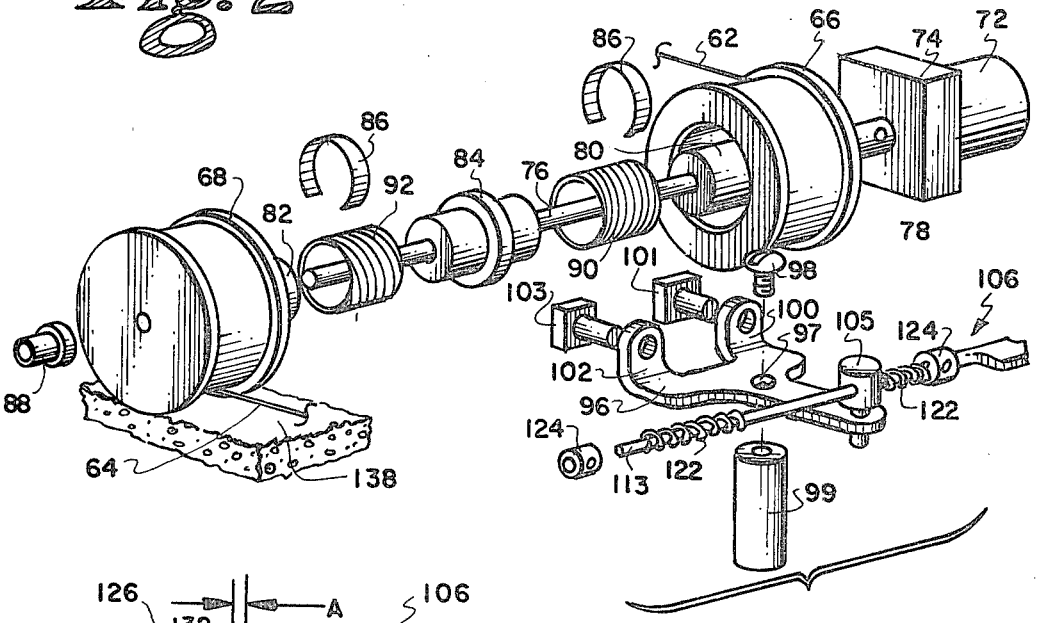
FIG. 3 is an exploded perspective view of the preferred apparatus of the invention.

The Genoa sail 42 is controlled remotely by a dual sheet winch mechanism generally designated as 60. A starboard sheet winch 66 (FIGS. 2 and 3) retains sheet 62 on the sheet winch at one end and at the opposite end of the sheet, the line is attached to the clew 40 of the Genoa sail. Similarly a port sheet winch 68 retains a port sheet 64 at one end, the opposite end of sheet 64 being attached to clew 40 of the Genoa 42. Both of the starboard and port sheet winches are driven by a geared electric motor 72. Actuation of the geared electric motor is accomplished by a remotely controlled servo mechanism 56 which actuates a micro switch within the switch apparatus 60 (FIGS. 2 and 3). A radio controlled receiver 54 is the device which actuates the servo mechanism 56. The starboard and port sheets are guided through the deck 22 of hull 12 through deck eyelets 52. The sheets then pass through a turning block 50 and from there to the clew 40 of the Genoa 42.

It can readily be seen then in FIG. 1 that the Genoa is controllable by actuating either the starboard sheet wintch to pull the clew end of the Genoa towards the starboard side of the hull while the port sheet is slack, the port winch being in a free-wheeling relationship with the drive shaft of the geared electric motor. FIG. 1 illustrates the starboard winch in operation wherein the sheet 62 is taught, being held in place by the locked starboard winch. These drums or sheet winches may be engaged, disengaged or locked by the fore and aft position of the servo mechanism 56 that is controlled by a remote transmitter/receiver device. Therefore, the model sailboat may be manipulated or controlled as precisely as a full-size sailboat.

Turning now to FIG. 2 the dual sheet winch apparatus, generally designated as 60, consists of a housing 70 which has affixed thereto a geared electric motor 72 which is mounted to the gear box 74. A drive shaft 76 extending from the gear box 74 is coupled to a torque limiter device 78. The torque limiting device prevents the electric motor from damage or the gear box 74 from damage by providing a buffer between the locked spools and the gears of the gear box or the electric motor mechanism. A starboard sheet 62 is wound on a starboard spool drum 66, the sheet being guided through the housing 70 by sheet guide 63. The sheet spool 66 has an inner hub 80 which extends beyond the face of the spool 66 so that it will fit within the inside diameter of a starboard spring clutch mechanism 90, the spring clutch mechanism 90 for the starboard spool 66 is affixed at one end to a center driving arbor 84. The spring clutch mechanism 90 is rigidly affixed to the driving arbor 84 by spring clip 86 (FIG. 3). A similar port spool or drum 68 retains port sheet 64, the sheet 64 being guided through the housing 70 by port sheet guide 65. Port spool 68 has an inner spring clutch hub 82 which fits within the port spring clutch mechanism 92 which is also attached to the driving arbor 84 by port spring retaining mechanism 86 (FIG. 3). The starboard spring clutch mechanism 90 and the port spring clutch mechanism 92 are wound in opposite directions so that each of these spools 66 and 68 will be driven in the same direction as the geared electric motor 72. The electric motor 72 drives drive shaft 76 in, for example, a clockwise direction, since the spring clutch mechanisms 90 and 92 face one another, one of the windings of the spring clutch mechanisms must be opposite the other of the spring clutch mechanisms so that when they are engaged with the spools they will drive in the same direction, namely in a clockwise direction. The end of the drive shaft 76 protrudes through housing 70 through a drive shaft bearing 88, thus supporting the end of the drive shaft. Each of the spools 66 and 68 are normally free-wheeling on the drive shaft 76 so that when the spring clutch mechanisms 90 and 92 are disengaged both of the spools are free-wheeling on shaft 76.

To drive one or the other of the spools, the spring clutch mechanism must be engaged by a bell crank assembly generally designated as 94. The bell crank 96 is mounted to the housing 70 by bell crank support post 99 (FIG. 3). The bell crank is retained in a pivot 97 by bell crank retaining screw 98.

Bell crank 96 consists of a starboard spool arm 100 and a port spool arm 102. The spool arm 100 supports a starboard clutch shoe mechanism 101 and the port spool arm 102 retains a port clutch shoe mechanism 103. Bell crank 96 is actuated by a third actuating arm 104 which has affixed at its end, actuating pivot 105. A lever arm generally designated as 106 is retained within housing 70 by a sliding bearing 108 near actuating end 112 and a sliding bearing 110 at the opposite end 113 of lever 106 where the end 113 extends through the housing 70. Actuating end 112 of lever arm 106 is connected to a servo wheel 111 of servo mechanism 56 by a servo actuating rod 114. The bell crank actuating arm 104 is connected to the lever arm 106 through the actuating pivot 105. The pivot 105 forms a sliding orifice bearing where the rod end 113 of the actuating lever arm 106 is directed through. A pair of bell crank springs are positioned on opposite sides of the actuating pivot 105 to provide a means of spring loading the bell crank device. A pair of spring keepers 124 are positioned on opposite sides of the springs 122. The keepers 124 have a set screw in each of them to enable the actuating arm of the bell crank to be put under various degress of compression by either moving the keeper inwardly to put more compression on each of these springs 122 or moving them outwardly to relieve the compression of the springs 122. The lever arm 106 has on one side a cam surface 126 which communicates with a micro switch following arm 128 connected to micro switch 130. Fore and aft movement of the lever arm actuates the micro switch 130 which in turn provides electrical energy to the geared electric motor 72. Actuation of the micro switch provides battery power 118 to the geared electric motor to start the motor which in turn rotates drive shaft 76. Simultaneously, movement of the lever arm causes the actuation arm 104 of the bell crank 96 to move causing either the starboard or port clutch shoe to engage one end of the spring clutch mechanisms 90 and 92 which binds that end of the spring clutch mechanisms to the hub 80 or 82 of the starboard or port winch 66 or 68, depending upon which clutch is engaged. The clutch shoe contact causes the spring to bind and coil thereby causing the spring clutch to reduce its overall diameter, thereby firmly gripping the hubs 80 amd 82 of the spools containing the sheet lines. As long as the lever arm 106 is moved fore or aft from a neutral position, the bell crank is rotated engaging one or the other clutch shoes with one or the other of the sheet spools, thereby manipulating the Genoa sail. The opposite spool of course is free-wheeling allowing the sheet to "run out" of the spool and to accommodate for the movement of the Genoa since both the starboard and the port sheet lines are attached to the clew of the Genoa at its opposite ends. Springs 122 provides a compressive force to the actuating arm (100 or 102) of the bell crank which in turn provides pressure to the shoes to firmly engage the spring clutch mechanism to the spools. A "drag" device 138, for example, a soft sponge material may be used at the base of the spools to control or retain the sheets 62 and 64 on the spools.

Figure 4:
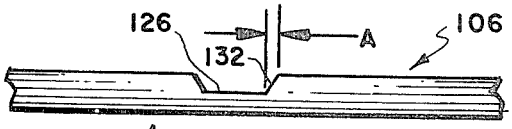
FIG. 4 is a plan view of the cam surface which actuates the micro switch within a narrow range of operation.
Figure 5:
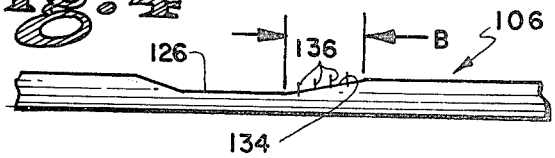
FIG. 5 is a plan view of the cam surface with a wide range of operation.

Turning to FIGS. 4 and 5 wherein the cam surface is illustrated, in FIG. 4 the slope 132 of cam surface 126 is very steep. Thus, when the cam follower 128 rides up on the steep slope 132, the geared electric motor 72 is actuated fairly abruptly. The slope 132 provides a narrow degree of control wherein the electric motor is either engaged or disengaged as the lever arm 106 is moved fore or aft. The distance "A" provides a narrow degree of control between the actuation and non-actuation of the electric motor. However, FIG. 5 illustrates a cam surface 126 with a slope 136 being fairly shallow, thus as the lever arm is moved fore or aft the cam follower rides up the shallow slope thus providing a larger degree of control to cam surface (distance "B"), thus allowing for a less sensitive means to start and stop the geared electric motor.

It should be realized that the electric motor may be engaged to rotate the drive shaft 76 at the same time moving the bell crank into engagement with one or the other of the spring clutches which engages the spool associated therewith. However, as the lever arm is moved in the opposite direction it can be seen that as the cam follower arm moves down the slope there will be a time when the electric motor energy source is cut off, yet the bell crank may be in a position wherein one of the clutches is still engaged with the spring clutch mechanism, thereby locking that particular spool to shaft 76 so that the Genoa is held in a "set" position. In other words the spool 66 or spool 68 is locked to the non-rotating shaft 76 due to the position of the cam follower on the slope 136 (FIG. 5) so that the motor is not operating yet the spool is still locked in position.

FIG. 3 illustrates the various relationships of the components within the housing 70. It can be seen in this illustration how the driving arbor 84 affixed to drive shaft 76 with the starboard and port spring clutch 90 and 92 mechanisms firmly attached thereto may engage with the starboard sheet 66 and port sheet 68 through hugs 80 and 82. The inside diameter of the spring clutch mechanism fitting loosely over the hubs 80 and 82 of the starboard and port sheet winches allowing the spools to rotate freely on shaft 76 until such time one or the other of the clutch shoes 101 or 103 engage the free end of the spring clutch mechanism, thereby causing these spring clutches to diminish in inside diameter because of the locking of one end of the spring clutch, thus causing the free end of the spring clutch to firmly grasp the hubs 80 or 82 of the sheet winches. Of course springs 122 on the lever arm 106 provide a degree of compression on each of the clutch shoes 101 and 103 so that as the bell crank rotates with the movement of the lever arm 106 a compression is applied to one or the other of the clutch shoe devices.

Thus it can be seen that the degree of slope (132 or 136, FIGS. 4 and 5) of the cam surface 126 relative to the micro switch following arm 128 provides a degree of control of the geared electric motor 72. The motor may be caused to rotate while still providing a means to either cause the port or starboard sheet winch to be engaged in a non-moving relationship with shaft 76, rotated or allowed to free-wheel on the shaft dependent upon the fore and aft position of the lever arm.

Obviously, the sail control mechanism heretofore described will work with a single spool for the control of a conventional model sailboat foresail with a boom that passes before the mast. A single spool with attendant spring clutch mechanism, control arm cam surface that actuates a micro switch and geared electric motor may be employed to provide a superior means to control a foresail with boom (not shown). Also, the single spool will provide superior control of a main sail trailing behind the mast of a model sailboat (not shown).

It will of course be realized that various modifications can be made in the design and operation of the present invention without departing from the spirit thereof. Thus, while the principal, preferred construction, and mode of operation of the invention have been explained and what is now considered to represent its best embodiment has been illustrated and described, it should be understood that within the scope of the appended claims the invention may be practiced otherwise than as specifically illustrated and described.

I claim:

1. A means to remotely manipulate at least one sail on a model sailboat to maneuver said sailboat upon a body of water comprising:

a housing, at least one sheet winch rotatable on a powered shaft positioned within said housing, said at least one sheet winch is free-wheeling on said shaft, the end of a sheet wound on said at least one sheet winch being attached to the clew of said at least one sail, the other end being connected to said sheet winch, at least one clutch mechanism means driven by said powered shaft positioned adjacent said at least one free-wheeling sheet winch to engage said at least one free-wheeling sheet winch with said powered shaft, said at least one clutch mechanism is a spring clutch connected at one end to a driving arbor connected to said powered shaft, the opposite end of said spring clutch concentrically overlapping a hub extending from said at least one sheet winch, said overlapping end of said spring clutch having an inside diameter slightly larger than the outside diameter of said hub to allow said at least one free-wheeling winch to rotate within said spring clutch when said clutch is disengaged with said hub of said winch, interference contact with said overlapping end of said at least one spring clutch by said means to simultaneously engage or disengage said winch results in the coils of the spring to retract thereby reducing the inside diameter of the overlapping end thus engaging the hub of said sheet winch, means mounted to said housing to remotely start and stop said powered shaft to drive said at least one sheet winch, and means to simultaneously engage or disengage said at least one free-wheeling sheet winch by said at least one clutch mechanism thereby reeling in or letting out or holding said at least one sail to port or starboard by said remote manipulating means.

2. The invention as set forth in claim 1 wherein said means to remotely start and stop said powered shaft to drive said at least one sheet winch is a servo mechanism to position a control arm retained within said housing back and forth a predetermined distance, said control arm being spaced from and substantially parallel to said powered shaft, said control arm further comprising a cam surface thereon to engage or disengage a trigger device mounted to said housing to start and stop said powered shaft, said trigger device being in communication with said cam surface of said control arm.

3. The invention as set forth in claim 2 wherein said servo mechanism is an electronic servo manipulated by a radio control system.

4. The invention as set forth in claim 3 wherein said powered shaft is driven by an electric motor.

5. The invention as set forth in claim 4 wherein said means to simultaneously engage or disengage said at least one free-wheeling sheet winch by said at least one spring clutch mechanism is a bell crank positioned between said powered shaft and said control arm pivotably mounted near the center of said bell crank to said housing, one arm of said bell crank being pivotably connected to said control arm, at least one opposite arm of said bell crank having brake pad means attached to the end of said opposite leg to engage said at least one spring clutch mechanism when said control arm rotates said bell crank to engage said brake pad means with said end of said spring clutch that overlaps said hub of said at least one sheet winch to drive said sheet winch.

6. A means to remotely manipulate a relatively large boomless foresail on a model sailboat to maneuver said sailboat upon a body of water comprising:

a housing, a first port side sheet winch rotatable on a powered shaft positioned within said housing, said port side sheet winch is free-wheeling on said shaft, the end of a sheet would on said port side sheet winch is attached to the clew of said boomless foresail, a starboard side sheet winch rotatable on said powered shaft positioned within said starboard side sheet winch is free-wheeling on said shaft, the end of a sheet wound on said starboard side sheet winch is attached to the clew of said boomless foresail, a port side spring clutch mechanism connected at a first end to a driving arbor connected to said powered shaft, said arbor being positioned between said port and starboard sheet winches, the opposite end of said port side spring clutch concentrically overlapping a hub of said port side sheet winch, said overlapping end of said port side spring clutch having an inner diameter slightly larger than the outside diameter of said hub of said port side sheet winch to allow said free-wheeling port side sheet winch to rotate within said port side spring clutch when said clutch is disengaged with said port side sheet winch, a starboard side spring clutch mechanism, said spring clutch having its windings wound opposite to the windings in said port side spring clutch mechanism, said starboard side spring clutch mechanism connected at a first end to said driving arbor positioned between said port and starboard winches, the opposite end of said starboard side spring clutch concentrically overlapping a hub of said starboard side sheet winch, said overlapping end of said starboard side spring clutch having an inner diameter slightly larger than the outside diameter of said hub of said starboard side sheet winch to allow said free-wheeling starboard side sheet winch to rotate within said starboard side spring clutch when said clutch is disengaged with said starboard side sheet winch, a servo mechanism operated by said remote manipulating means to position a control arm retained within said housing back and forth a predetermined distance, said control arm further comprising a cam surface thereon to engage or disengage a trigger device mounted to said housing to start and stop said powered shaft, said trigger device being in communication with said cam surface of said control arm, and bell crank means to engage or disengage said port and starboard sheet winches by manipulation of said port and starboard spring clutch mechanisms, said bell crank is positioned between said powered shaft and said control arm and is pivotally mounted near the center of the bell crank to said housing, a first arm of said bell crank is pivotably connected to said control arm, a second and third arm of said bell crank in substantially parallel relationship with one another, are positioned 180 degrees from said first arm, said second and third arms having brake pad means attached to the ends of said second and third arms, each brake pad is spaced from and adjacent said hubs of said port and starboard sheet winches when said bell crank is positioned in a neutral position by said control arm, when said control arm is moved passed a neutral position, said bell crank is rotated which engages either the port or starboard sheet winch, interference contact by said brake pad with said overlapping end of said port or starboard spring clutch mechanism results in the coils of the spring to retract thereby reducing the inside diameter of the overlapping end thus engaging the port or starboard hub of said sheet winch, said bell crank and said trigger device being operated simultaneously by said remotely manipulated serve connected to said control arm to start and stop said powered shaft and to engage or disengage either the port or starboard sheet winch to provide a precise means to move out, pull in or set the clew of said foresail whether the sail is on the port or starboard side or transitioning therebetween on said model sailboat.

7. The invention as set forth in claim 6 wherein said triggering device is a micro switch.

* * * * *